US005379844A

United States Patent [19]

Glasscock et al.

[11] Patent Number: 5,379,844

[45] Date of Patent: Jan. 10, 1995

[54] OFFSHORE PLATFORM WELL SYSTEM

[75] Inventors: M. Sidney Glasscock, Houston, Tex.; Gerasime M. Monopolis, Morristown, N.J.

[73] Assignee: Exxon Production Research Company, Houston, Tex.

[21] Appl. No.: 13,506

[22] Filed: Feb. 4, 1993

[51] Int. Cl.[6] ..... E21B 43/013; F21B 7/128

[52] U.S. Cl. ..... 166/358; 166/366; 175/5

[58] Field of Search ..... 166/350, 351, 358, 359, 166/366, 367; 175/5, 8

[56] References Cited

U.S. PATENT DOCUMENTS

| | | | |
|---|---|---|---|
| Re. 32,119 | 4/1986 | Abbott et al. | 405/227 |
| 2,586,966 | 2/1952 | Kuss et al. | 61/46 |
| 3,224,204 | 12/1965 | Siebenhausen | 61/46.5 |
| 3,608,652 | 9/1971 | Medders et al. | 175/7 |
| 3,664,423 | 5/1972 | Holbert, Jr. | 166/297 |
| 3,741,294 | 6/1973 | Morrill | 166/0.5 |
| 4,126,008 | 11/1978 | Dixon | 405/207 |
| 4,260,291 | 4/1981 | Young et al. | 405/205 |
| 4,305,468 | 12/1981 | Goldsmith | 166/359 |
| 4,310,052 | 1/1982 | Rivertz | 166/366 |
| 4,468,157 | 8/1984 | Horton | 405/224 |
| 4,553,878 | 11/1985 | Willemse et al. | 405/203 |
| 4,625,806 | 12/1986 | Silcox | 166/358 |
| 4,669,917 | 6/1987 | Sveen | 405/227 |
| 4,669,918 | 6/1987 | Riles | 405/227 |
| 4,687,062 | 8/1987 | Beghetto et al. | 166/366 |
| 4,705,430 | 11/1987 | Will | 405/227 |
| 4,721,417 | 1/1988 | Piazza et al. | 405/227 |
| 4,822,212 | 4/1989 | Hall et al. | 405/227 |
| 4,881,852 | 11/1989 | Gunderson | 405/224 |
| 4,895,481 | 1/1990 | Pepin-Lehalleur et al. | 405/224 |
| 4,907,914 | 3/1990 | Gunderson et al. | 405/224 |
| 4,934,872 | 6/1990 | Klausen | 405/227 |
| 5,184,686 | 2/1993 | Gonzalez | 175/5 |

*Primary Examiner*—William P. Neuder
*Attorney, Agent, or Firm*—Keith A. Bell

[57] ABSTRACT

A well system, and a method for installing the well system, for use in producing hydrocarbons from a subterranean reservoir located beneath a body of water is disclosed. The well system is intended for use in conjunction with a bottom-founded offshore platform. The inventive well system eliminates the conductors traditionally used in offshore platform well systems. According to the invention, a subsea guide template and an outer casing string extending downwardly from the guide template to a first predetermined depth less than the depth of the reservoir are installed prior to installation of the offshore platform. Thereafter, the platform and the first intermediate casing string are installed, in either order. Drilling for the first intermediate casing string takes place in the open hole defined by the outer casing string with all returns of drilling fluid and drill cuttings occurring at the seafloor. Preferably, the in-water portion of the first intermediate casing string serves as a removable drilling riser for conducting all subsequent drilling operations. The well is then completed in the conventional manner. The present invention may advantageously be combined with pre-installation of some or all of the platform's foundation piles to provide the added benefit of achieving a "storm-safe" condition in a matter of a few hours.

21 Claims, 8 Drawing Sheets

OFFSHORE PLATFORM WELL SYSTEM

FIELD OF THE INVENTION

The present invention relates to well systems for use in producing hydrocarbons from offshore reservoirs. More particularly, but not by way of limitation, the invention pertains to a well system, and a method for installing the well system, for a bottom-founded offshore platform.

BACKGROUND OF THE INVENTION

Offshore hydrocarbon drilling and producing operations are typically conducted from either a bottom-founded offshore platform or a floating platform. As used herein, a "bottom-founded offshore platform" is any offshore platform which extends from the floor of the body of water upwardly to a deck located above the surface of the body of water and in which at least a portion of the weight of the platform is supported by the subsea foundation, and a "floating platform" is any ship, vessel, or other structure (e.g., a tension-leg platform) in which the weight of the platform is supported by buoyancy. The equipment and procedures used in installing a well on a bottom-founded offshore platform vary significantly from those used in installing a well on a floating platform. The principal reason for this variation is that some means must be provided for supporting the in-water portion of the well string which may be 2500 feet or more in length. On a bottom-founded offshore platform, guide sleeves are typically spaced along the length of the in-water portion. These guide sleeves provide lateral support for the in-water portion and are spaced at intervals which will prevent it from buckling under its own weight and the weight of its contents. Accordingly, the in-water portion of the well strings for a bottom-founded offshore platform are typically axially (i.e., vertically) self-supporting. On a floating platform, it is not practical to provide lateral support for the in-water portion of the well strings. Therefore, some method for maintaining the risers in tension must be provided in order to prevent them from buckling. Suitable methods include attaching buoyancy means to the upper end of the riser or using a pneumatic or hydraulic riser tensioner, well known in the art, located on the floating platform to maintain an upward load on the riser.

Well systems for bottom-founded offshore platforms traditionally include an outer casing string, known as a "conductor" (also known as a "drive pipe"), extending from the deck of the platform downwardly through the water and into the earth below the seafloor. All subsequent drilling operations for the well are performed through this conductor. Typically, conductors are driven down to a depth where the surrounding soils are cohesive enough that they will not slough into the open hole during subsequent drilling operations. The formation below the conductor should also be strong enough so that it will not fracture during subsequent drilling operations. As is well known in the art, the hydrostatic pressure exerted by a column of drilling fluid extending upwardly to the deck of the offshore platform can be high enough to fracture shallow formations which can result in lost returns and potentially in loss of the well. This problem can be especially severe in deep waters where the hydrostatic pressure of the drilling fluid becomes quite large.

Following installation of the conductors, drilling for the next casing string commences. During this drilling operation, drilling fluid and drill cuttings are typically returned at the deck of the offshore platform. This requires that significant volumes of drilling fluid be circulated down the drill string and then up the annulus between the drill string and the conductor in order to keep the drill cuttings in suspension as they are transported up the conductor. Accordingly, the speed of the drilling operation is limited by the cuttings transport capability of the drilling fluid circulation system. Again, this problem is especially severe in deep waters.

Well systems for bottom-founded offshore platforms typically include a gas diverter under the rig floor. This is because it is not uncommon for shallow pockets of natural gas (or other gases) to be encountered during the initial stages of drilling. If this should occur, the gas can flow up the conductor to the rig floor where it can be a potential safety hazard.

Conductors for bottom-founded offshore platforms are traditionally installed by a floating construction vessel after installation of the platform jacket. The conductors may be as much as 36 inches or more in diameter, and a typical platform has a plurality (up to 48 or more) of wells. As water depth increases, the material and installation costs of the conductors for a platform can become prohibitive. Also, the offshore platform itself must be strong enough to resist the hydrodynamic loads resulting from waves and ocean currents impacting the conductors. Due to the size and number of the conductors, the cost of the additional steel required to resist these loads can be significant.

Installation of a bottom-founded offshore platform can be an expensive and risky operation. Traditionally, the platform jacket is constructed at an onshore fabrication yard, transported to the installation site on a barge and offloaded, and then uprighted by flooding a portion of the legs and gradually lowered to the seafloor. Once the platform jacket is in place on the seafloor, a plurality of foundation piles are assembled, driven into the earth, and attached to the platform jacket. Assembly of the foundation piles requires that successive sections of large diameter pipe be connected end-to-end by welding or mechanical connectors as the pile is gradually lowered toward the seafloor. The pile driving operation is typically performed from one or more expensive offshore construction vessels and can take several days to accomplish. During this period it is possible that a severe storm (e.g., a hurricane) could arise. If a storm arises before the platform has been made "storm-safe", the entire platform jacket could be lost. Alternatively, the foundation piles may be assembled, as described above, and then installed by drilling and grouting, as is well known in the art. Further, it is possible that the foundation piles could be pre-installed (see U.S. Pat. No. 4,669,918 to Riles) thereby reducing the time needed to achieve a "storm-safe" condition.

Following installation of the platform jacket and the foundation piles, the same construction vessels are typically used to install the platform conductors. This is accomplished in a similar manner to installation of the foundation piles. The conductors are gradually assembled by welding or mechanically joining sections of pipe end-to-end, lowering the assembled pipe sections through the guide sleeves, and then driving them into the earth. Alternatively, in certain types of soils it may be necessary to drill a borehole into the earth and then grout (cement) the conductor in place.

It will be apparent from the foregoing that installation of a bottom-founded offshore platform and its associated wells is a complex, time-consuming, and expensive process, especially in deeper waters. Accordingly, a need exists for a method of installing a bottom-founded offshore platform and its associated wells which overcomes the problems described above.

SUMMARY

The present invention is a well system for use on a bottom-founded offshore platform. The invention includes a staged method for installing the platform and its wells which overcomes or greatly mitigates the problems described above.

According to the invention, the first step in installing the platform and wells is to position a subsea guide template having at least one substantially vertical well slot on the seafloor generally above the subterranean reservoir. This guide template provides a dimensional reference for all subsequent operations. Following installation of the guide template, the outer casing string for the well is driven through the well slot downwardly to a first predetermined depth less than the depth of the reservoir. The outer casing string is terminated at the guide template and does not extend upwardly to the surface of the body of water.

Following installation of the guide template and outer casing string, an intermediate casing string and the offshore platform are installed. These steps may occur in either order. In one embodiment of the invention, the intermediate casing string is installed before installation of the offshore platform. In this embodiment, a floating drilling vessel is used to drill a borehole through the outer casing string with the drill cuttings being returned at the seafloor thereby reducing the possibility of fracturing the formations being penetrated. Additionally, any shallow pockets of gas encountered are vented at the seafloor. The intermediate casing string is then installed through the outer casing string and extends from the guide template downwardly to a second predetermined depth deeper than the depth of the outer casing string but less than the depth of the reservoir. In another embodiment of the invention, the offshore platform is installed before the intermediate casing string. In this embodiment, the offshore platform's drilling rig is used to drill the borehole for the intermediate casing string with drill cuttings being returned at the seafloor and shallow pockets of gas being vented at the seafloor.

Following installation of the intermediate casing string and the offshore platform, a drilling riser extending upwardly to the deck of the offshore platform is connected to the upper end of the intermediate casing string and a conventional blow-out preventer is attached to the top of the drilling riser. Preferably, the drilling riser is releasably connected to the intermediate casing string. Thereafter, one or more additional casing strings are installed in the conventional manner, and the well is completed. The drilling riser may then be disconnected from the intermediate casing string and removed for possible reuse on another well.

The guide template preferably includes one or more foundation pile guides for pre-installing the platform's foundation piles. The pre-installed foundation piles are mated to the platform as it is lowered to the seafloor and connected by a mechanical connecting means. In this manner, the platform can be made storm-safe in a matter of a few hours rather than days.

BRIEF DESCRIPTION OF THE DRAWINGS

The present invention and its advantages will be better understood by referring to the following detailed description and the attached drawings in which.

Figure 1E:
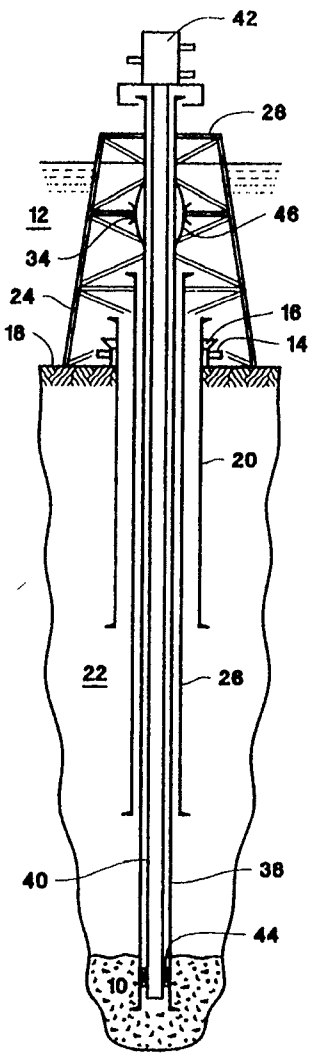
FIGS. 1A through 1E schematically illustrate a first embodiment of the well system of the present invention.

While the invention will be described in connection with its preferred embodiments, it will be understood that the invention is not limited thereto. On the contrary, it is intended to cover all alternatives, modifications, and equivalents which may be included within the spirit and scope of the invention,as defined by the appended claims.

DETAILED DESCRIPTION OF THE PREFERRED EMBODIMENTS

The present invention is a well system for use in producing hydrocarbons from a subterranean reservoir located beneath a body of water. The invention includes both the novel well system itself and the method for installing the well system. In a first embodiment, the inventive well system comprises (a) a guide template located on the seafloor and having at least one substantially vertical well slot extending therethrough, (b) an outer casing string installed in the guide template well slot and extending from the guide template downwardly to a first predetermined depth less than the depth of the reservoir, (c) a bottom-founded offshore platform installed after installation of the guide template and the outer casing string and extending from the seafloor upwardly to a deck located above the surface of the body of water, (d) an intermediate casing string installed inside the outer casing string and extending from the guide template downwardly to a second predetermined depth deeper than the first predetermined depth but less than the depth of the reservoir, (e) an inner casing string installed inside the intermediate casing string and extending from a wellhead located on the deck of the offshore platform downwardly to the reservoir, and (f) a production tubing string installed inside the inner casing string and extending from the wellhead downwardly to the reservoir for producing hydrocarbons to the deck of the platform. In a second embodiment of the invention, the intermediate casing string extends upwardly from the guide template to the deck of the offshore platform with the upward extension serving as a drilling riser for conducting subsequent drilling operations. In a third embodiment, the invention includes one or more additional intermediate casing strings each of which extends downwardly to a predetermined depth deeper than the depth of the next larger casing string but less than the depth of the reservoir.

The well system of the present invention has a number of advantages over prior well systems for offshore hydrocarbon producing operations. For example, use of the inventive well system reduces the probability of fracturing formations during the initial stages of drilling and setting the first casing strings by reducing the height of the fluid column acting on the formations. The present invention eliminates the traditional well conductors thereby increasing the efficiency and safety of the drilling operation. Elimination of the conductors also reduces the total mass of pipe and associated fittings needed for the well system thereby reducing the overall cost of the well system. Other advantages include a reduction in the fluid volume needed for handling and disposing of drill cuttings during the initial stages of drilling and a reduction in the overall lateral loads acting on the well system and the platform. Further, the invention permits both the foundation piles for the offshore platform and the initial portions of the well system to be installed using the same construction equipment. These and other advantages of the invention will be readily apparent to persons skilled in the art based on the teachings set forth below. To the extent that the following description is specific to a particular embodiment or a particular application of the invention, this is intended as illustrative and is not to be construed as limiting.

Figure 1D:
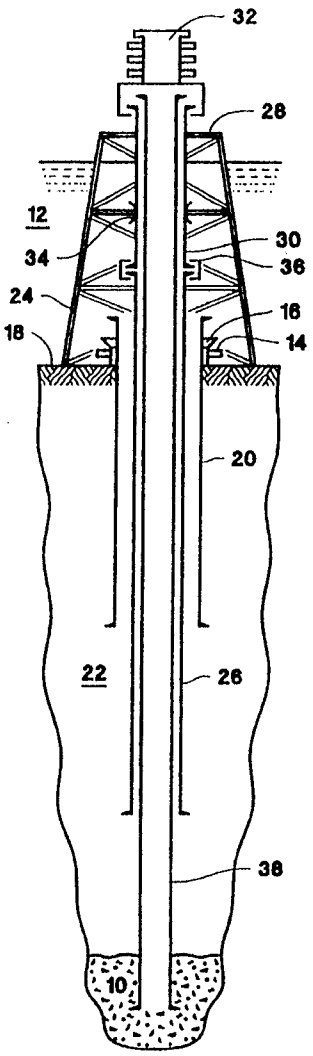
Figure 1C:
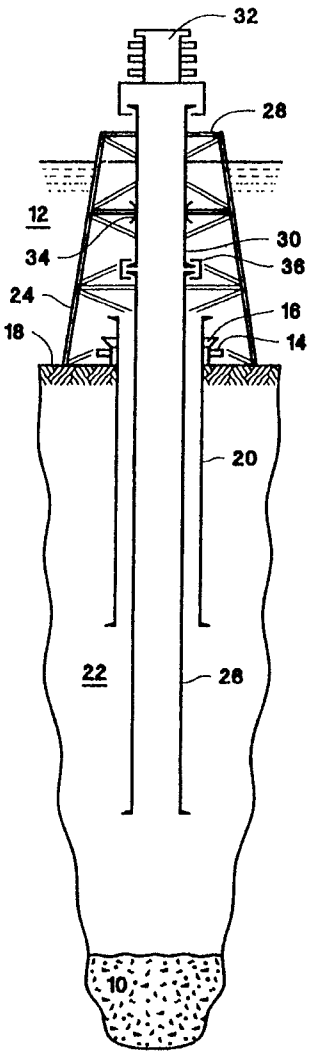
Figure 1B:
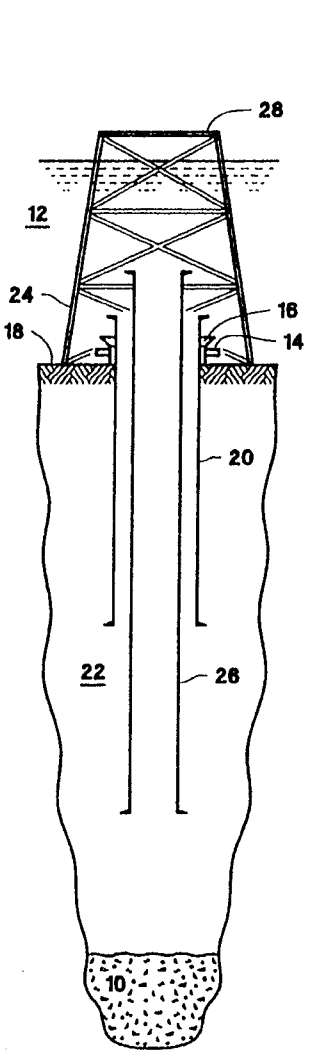
Figure 1A:
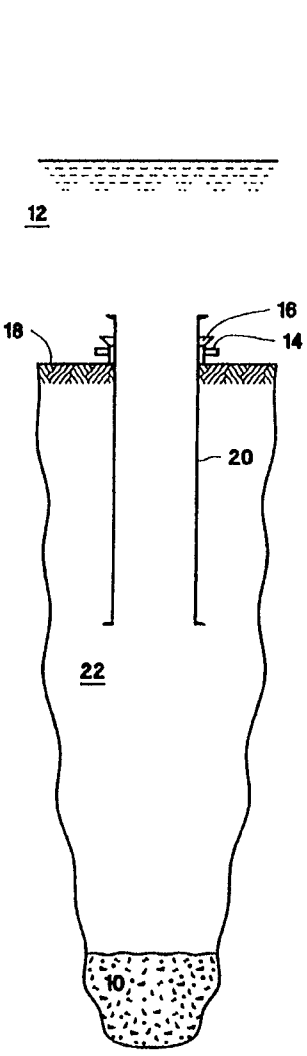

Turning now to FIGS. 1A through 1E, the well system of the present invention will be described generically in connection with producing hydrocarbons from subterranean reservoir 10 located beneath body of water 12. As illustrated in FIG. 1A, the first step in installing the inventive well system is to position a subsea guide template 14 having at least one substantially vertical well slot 16 on the seafloor 18 generally above reservoir 10. Typically, the guide template 14 would be attached to the seafloor 18 by one or more substantially vertical piles, as more fully described below. Following installation of guide template 14, outer casing string 20 is installed through well slot 16 into the earth 22 beneath seafloor 18. Preferably, outer casing string 20 extends from a point at or slightly above the top of guide template 14 downwardly to a first predetermined depth less than the depth of reservoir 10. Typically, outer casing string 20 would extend downwardly to a depth of 150 to 400 feet below the sea floor 18 depending on the subterranean formation conditions and the final well design. Outer casing string 20 may be installed by drilling and grouting, pile driving, jetting, or any other installation technique known to those skilled in the art. A floating drilling vessel or construction vessel would be used for installation of guide template 14 and outer casing string 20.

Referring now to FIG. 1B, a bottom-founded offshore platform 24 has been installed above guide template 14 and an intermediate casing string 26 has been installed into the earth 22 through outer casing string 20. The sequence of these two events may be reversed without departing from the scope of the present invention. Specifically, offshore platform 24 may be installed before installation of intermediate casing string 26, in which case a drilling rig (not shown) located on deck 28 of offshore platform 24 would be used to install intermediate casing string 26. Alternatively, intermediate casing string 26 may be installed before installation of offshore platform 24 using the same floating drilling vessel or construction vessel which was used to install guide template 14 and outer casing string 20. Preferably, intermediate casing string 26 extends from a point at or slightly above the top of outer casing string 20 downwardly to a second predetermined depth deeper than the depth of the outer casing string 20 but less than the depth of the subterranean reservoir 10. Generally, intermediate casing string 26 extends downwardly to a depth of 1000 to 3000 feet below the seafloor 18 depending on the subterranean formation conditions and the final well design.

Typically, intermediate casing string 26 is installed by drilling a borehole through outer casing string 20 and then running intermediate casing string 26 into the borehole and cementing it in place in the well known manner. Those skilled in the art will understand that the borehole drilling operation for intermediate casing string 26 (whether conducted from deck 28 of offshore platform 24 or from a floating drilling vessel or construction vessel prior to installation of offshore platform 24) is conducted in an open hole and, accordingly, that all returns of drilling fluid and drill cuttings take place at the seafloor 18. This may have the added benefit of permitting faster drilling operations since it is not necessary to transport the drill cuttings upwardly to the deck 28 of the offshore platform 24. Also, any shallow pockets of gas encountered during this drilling operation are advantageously vented at the seafloor 18. As will be apparent to those skilled in the art, use of this open hole drilling technique for installing intermediate casing string 26 reduces the possibility of fracturing shallow formations during the drilling operation. However, since there is no blow-out preventer in an open hole drilling operation, care should be exercised to avoid drilling into a highly pressurized formation or losing drilling fluids downhole.

Turning now to FIG. 1C, a drilling riser 30 has been connected to the upper end of intermediate casing string 26 and a blow-out-preventer 32 has been connected to the upper end of the drilling riser 30. Drilling riser 30 extends through one or more guide sleeves 34 connected to offshore platform 24. Typically, a plurality of guide sleeves 34 would be spaced along the length of drilling riser 30 to provide lateral support to drilling riser 30, as is well known to those skilled in the art. Preferably, a flange-type connector 36 or other releasable connecting means is used to connect the lower end of drilling riser 30 to the upper end of intermediate casing string 26. Alternatively, if it is not desired to remove the drilling riser 30 after completion of the well, as more fully described below, then drilling riser 30 may simply be an upward extension of intermediate casing string 26. In this case, no releasable connecting means would be needed. Blow-out-preventer 32 permits subsequent drilling operations to be conducted in the conventional manner. A drilling rig (not shown) located on deck 28 of offshore platform 24 would be used for these subsequent drilling operations.

As illustrated in FIG. 1D, the next step in installing the inventive well system is to install an inner casing string 38. Using the offshore platform's drilling rig, a borehole is drilled through intermediate casing string 26 downwardly into reservoir 10. Inner casing string 38 is then installed in the borehole and extends from blow-out-preventer 32 downwardly to the subterranean reservoir 10 and is cemented in place using conventional procedures. During drilling of the borehole and installation of inner casing string 38, blow-out-preventer 32 is used to control the well in the manner well known in the art.

FIG. 1E illustrates the completed well system of the present invention. Production tubing 40 has been installed inside inner casing string 38, a conventional production tree 42 has been substituted for blow-out-preventer 32, and drilling riser 30 has been removed for possible reuse on another well. A packer 44 is used to prevent well fluids from flowing up the annulus between production tubing 40 and inner casing string 38. Centralizers 46 or other similar means are installed between guide sleeves 34 and inner casing string 38 in order to provide lateral support for inner casing string 38. Alternatively, drilling riser 30 may be retained to provide lateral support for inner casing string 38, in which case centralizers 46 would not be needed.

Figure 2:
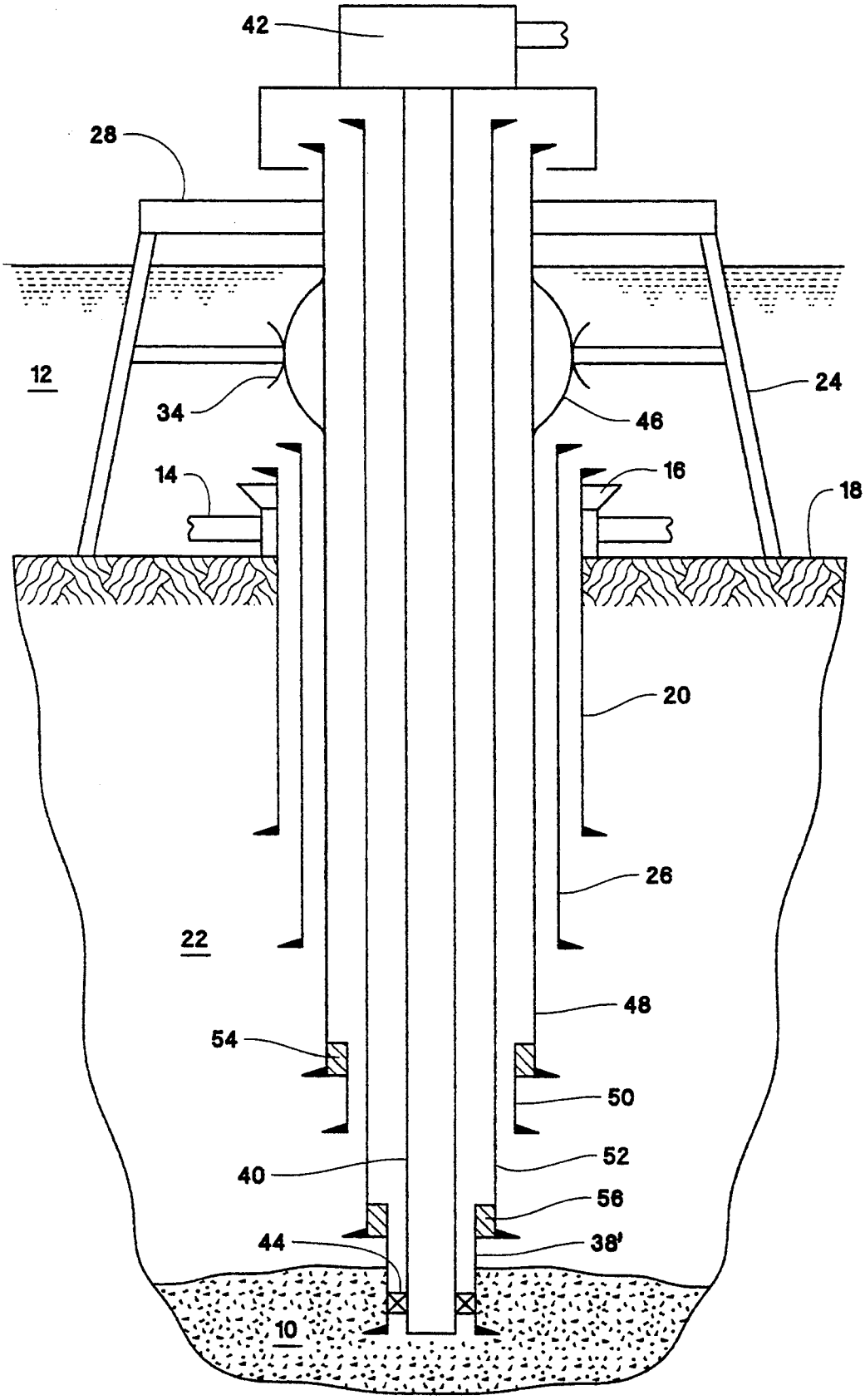
FIG. 2 schematically illustrates a second embodiment of the invention.

FIGS. 1A through 1E illustrate an embodiment of the invention in which only one outer casing string, one intermediate casing string, and one inner casing string are used. It will be understood by those skilled in the art that many well systems utilize additional intermediate casing strings and that the present invention is equally applicable to such well systems. FIG. 2 illustrates a typical Gulf of Mexico well system which comprises outer casing string 20 (as described above), intermediate casing string 26 (as described above), three additional intermediate casing strings 48, 50, and 52 (as described below), inner casing string 38' (as described below), and production tubing string 40 (as described above). As illustrated, intermediate casing strings 48 and 52 are full length casing strings extending downwardly from the deck 28 of offshore platform 24. Intermediate casing string 50 and inner casing string 38' comprise liners which extend downwardly from subterranean liner hangers 54 and 56, respectively. Each of the intermediate casing strings 48, 50, and 52 extends downwardly to a predetermined depth deeper than the depth of the next larger casing string but less than the depth of reservoir 10. As is well known in the art, it is not necessary for all casing strings to extend upwardly to the deck 28 of offshore platform 24. It is only necessary that the innermost casing string be continuous from the wellhead to the reservoir. In the embodiment illustrated in FIG. 1E, inner casing string 38 serves this function. In the embodiment illustrated in FIG. 2, inner casing string 38' and intermediate casing string 52 jointly serve this function.

Other possible well profiles will be apparent to those skilled in the art. The ultimate wellbore profile for the well is typically governed by a number of factors such as the ultimate depth of the well, the anticipated formation pressures, and the anticipated production pressures and volumes.

The well system illustrated in FIG. 2 is installed in the same manner as previously described. Specifically, the initial steps are to position guide template 14 on the seafloor 18 generally above reservoir 10 and to install outer casing string 20 through well slot 16 into the earth 22. Outer casing string 20 extends downwardly to a first predetermined depth less than the depth of reservoir 10. Next, offshore platform 24 and intermediate casing string 26 are installed, in either order as described above. Intermediate casing string 26 extends downwardly to a second predetermined depth deeper than the first predetermined depth but less than the depth of the reservoir 10. Following installation of offshore platform 24 and intermediate casing string 26, a drilling riser (not shown ) extending from the top of intermediate casing string 26 upwardly to a blow-out preventer (not shown) located on the deck 28 of offshore platform 24 is installed. Intermediate easing strings 48, 50, and 52 and inner casing string 38' are then installed in the conventional manner using a drilling rig (not shown) located on deck 28 of offshore platform 24. Finally, production tubing string 40, packer 44, and production tree 42 are installed in the conventional manner and, preferably, the drilling riser is removed, as described above, for possible reuse on another well. It is also possible that the portion of other intermediate casing strings above the seafloor 18 could be eliminated. For example, in the embodiment illustrated in FIG. 2, the portion of intermediate casing string 48 above the seafloor 18 could be eliminated and intermediate casing string 48 could be suspended from a "mudline suspension", as is well known in the art. Obviously, in this case centralizer 46 would need to be larger to provide lateral support to intermediate casing string 52.

The sizes of each of the casing strings in a typical well will vary depending on the final well design. However, for illustrative purposes, outer casing string 20 would typically be a pipe having a diameter of between 26 inches and 36 inches and inner casing string 38 or 38' would typically be a pipe having a diameter of between 6 inches and 1 inches.

With reference now to FIGS. 3 through 8, the well system of the present invention will be described and illustrated in connection with the installation of a compliant piled tower or "CPT" and its associated wells. However, it will be understood by those skilled in the art that the methods described hereinafter are equally applicable to installation of any other type of bottom-founded offshore platform and its associated wells. Accordingly, the following description is intended as illustrative of the invention and is not to be construed as limiting.

Figure 3:
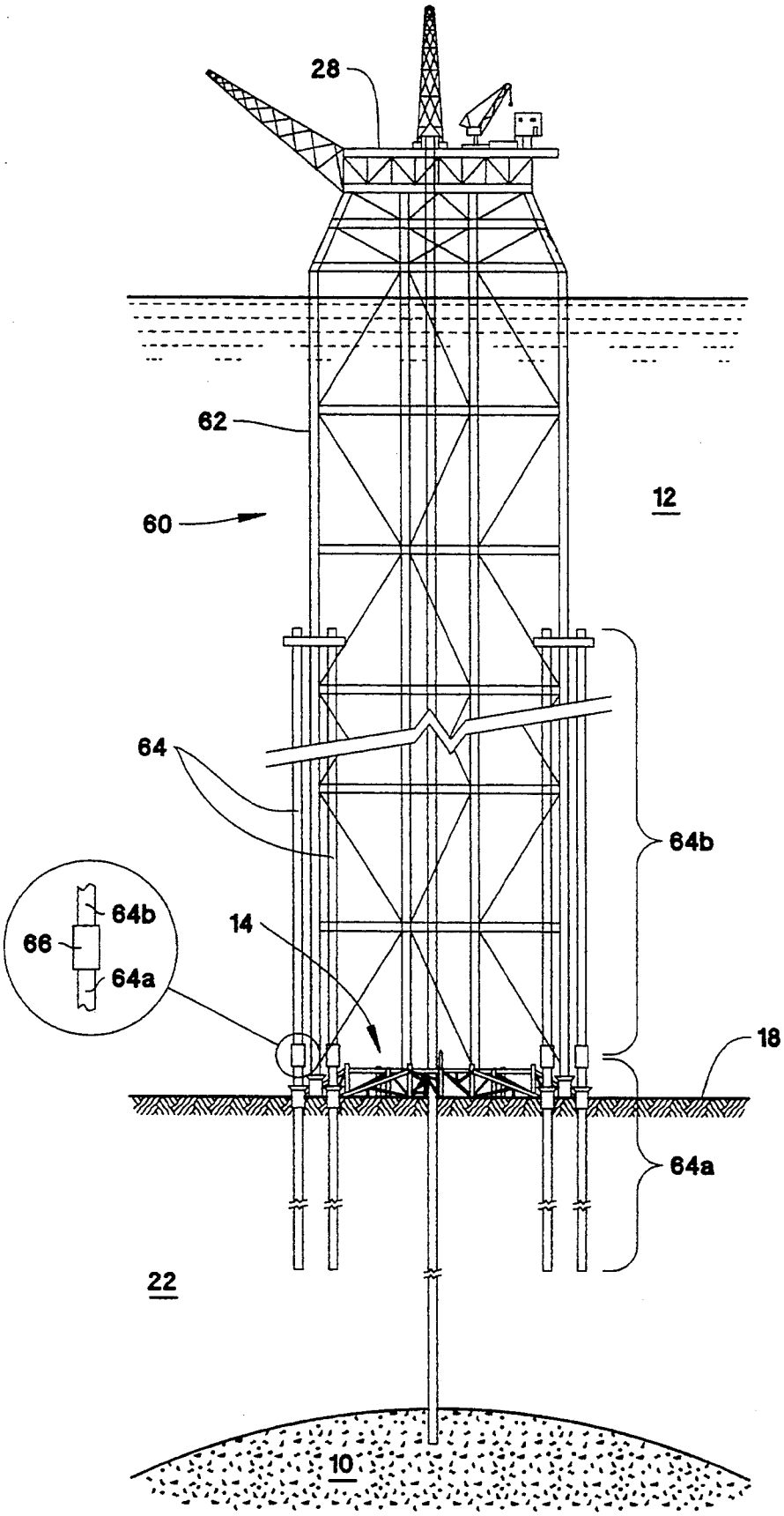
FIG. 3 illustrates a compliant piled tower offshore platform which utilizes the well system of the present invention.

As illustrated in FIG. 3, a CPT, generally indicated at 60, is a type of bottom-founded offshore platform which is primarily intended for use in deep waters where the costs of rigidly resisting environmental forces such as wind, waves, and ocean currents become prohibitive. Rather than rigidly resisting these forces, a CPT yields to them in a controlled manner. This compliance significantly reduces the amount of steel required for the platform.

Generally, a CPT comprises a deck 28 located above the surface of body of water 12, a tower structure 62 extending from the sea floor 18 upwardly to deck 28, and a foundation consisting of a plurality of elongated piles 64. Typically, each pile 64 comprises a lower foundation pile portion **64*a* and an upper spring pile portion 64*b* joined by a connecting means 66. Spring piles 64*b* may be direct vertical continuations of foundation piles 64*a* or may be offset at or near the seafloor 18. The foundation piles 64*a* support the weight of CPT 60. The spring piles 64*b* extend upwardly from seafloor 18 a substantial distance (generally between 33% and 100% of the length of the tower structure) and are attached to the tower structure 62 only at their upper ends. The spring piles 64*b* act as linear springs to provide a restoring force after the CPT has pivoted away from vertical in response to an environmental force. Tower structure 62 may be a tubular steel space frame, as illustrated in FIG. 3**, or alternatively, a concrete shell structure (not shown).

Figure 4:
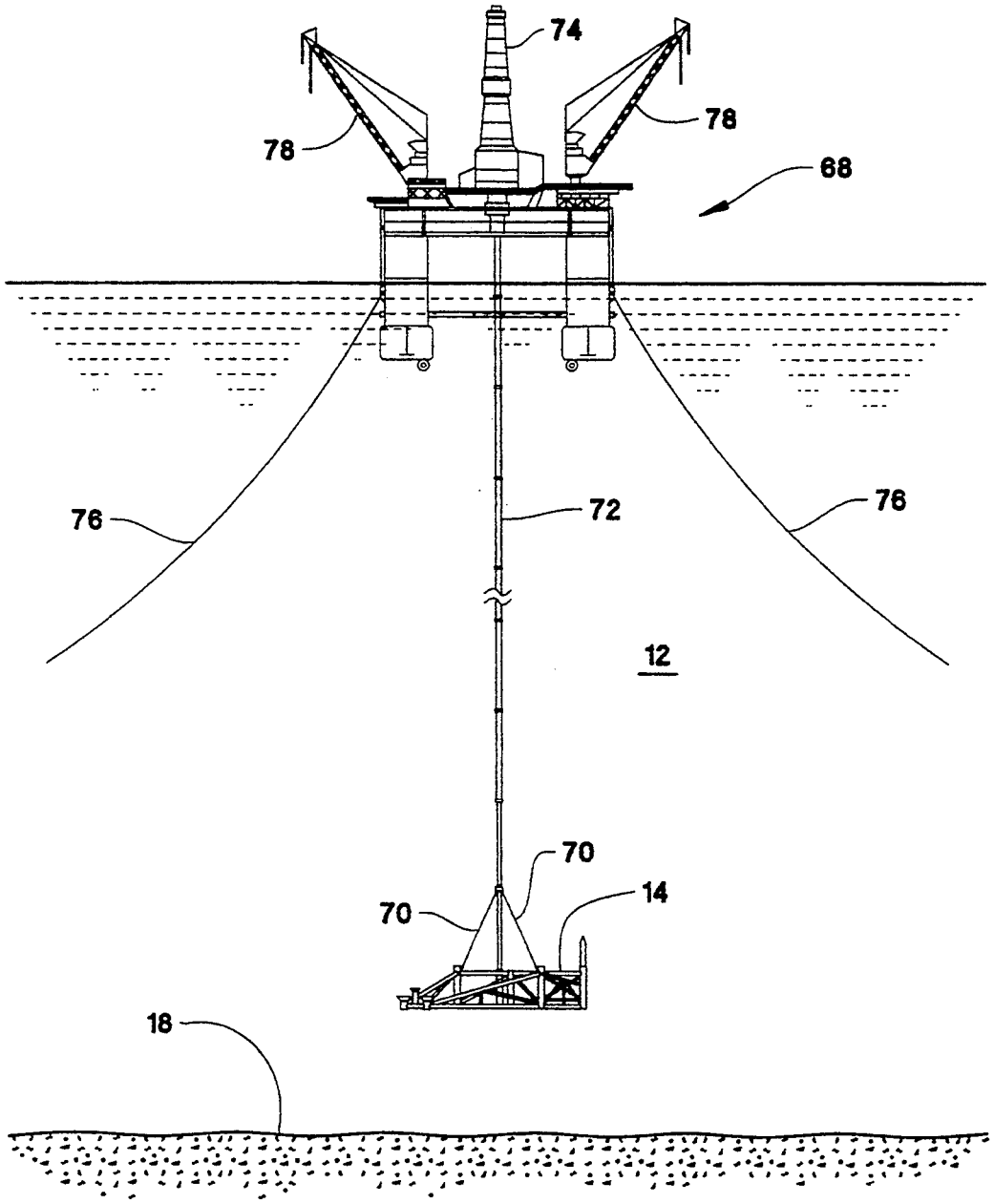
FIG. 4 illustrates installation of the guide template of the present invention using a floating drilling vessel.

According to the present invention, the first step in installing CPT 60 and its associated wells is to position guide template 14 on seafloor 18. As illustrated in FIG. 4, one method for installing guide template 14 is to lower it from a floating drilling vessel 68. Guide template 14 is attached to drill string 72 which is suspended from the drawworks (not shown) of drilling FIG. 74. Slings 70 may be used to maintain the horizontal orientation of guide template 14 as it is lowered. The guide template 14 is lowered by adding successive joints of pipe to drill string 72, as is well known in the art. During the lowering operation, means such as an acoustic positioning system or a remotely-operated vehicle (not shown) may be used to ensure that template 14 is correctly positioned on seafloor 18. Typically, guide template 14 would include one or more mudmats on its bottom surface to prevent guide template 14 from penetrating too far into the soft soils of seafloor 18.

As illustrated in FIG. 4, floating drilling vessel 68 is a semisubmersible vessel maintained in position by a plurality of mooring lines 76. It will be understood by those skilled in the art that floating drilling vessel 68 could also be a drill ship and that mooring lines 76 could be replaced by a dynamic positioning system. It will be further understood by those skilled in the art that guide template 14 could be lowered by a cable attached to one of the cranes 78 located on floating drilling vessel 68 rather than by drill string 72. Alternatively, floating drilling vessel 68 could be replaced by a floating construction vessel in which case a crane would be used to lower guide template 14 to the seafloor.

The primary purpose of guide template 14 is to provide a dimensional reference for installing the platform and its associated wells. Guide template 14 may be a single unit or, alternatively, a plurality of separate units designed to be remotely assembled on the seafloor 18. Also, the guide template may have any shape or configuration desired. Preferably, guide template 14 includes means for locating and guiding the installation of the platform's foundation piles as well as means for locating and guiding the installation of the platform's wells.

Figure 5:
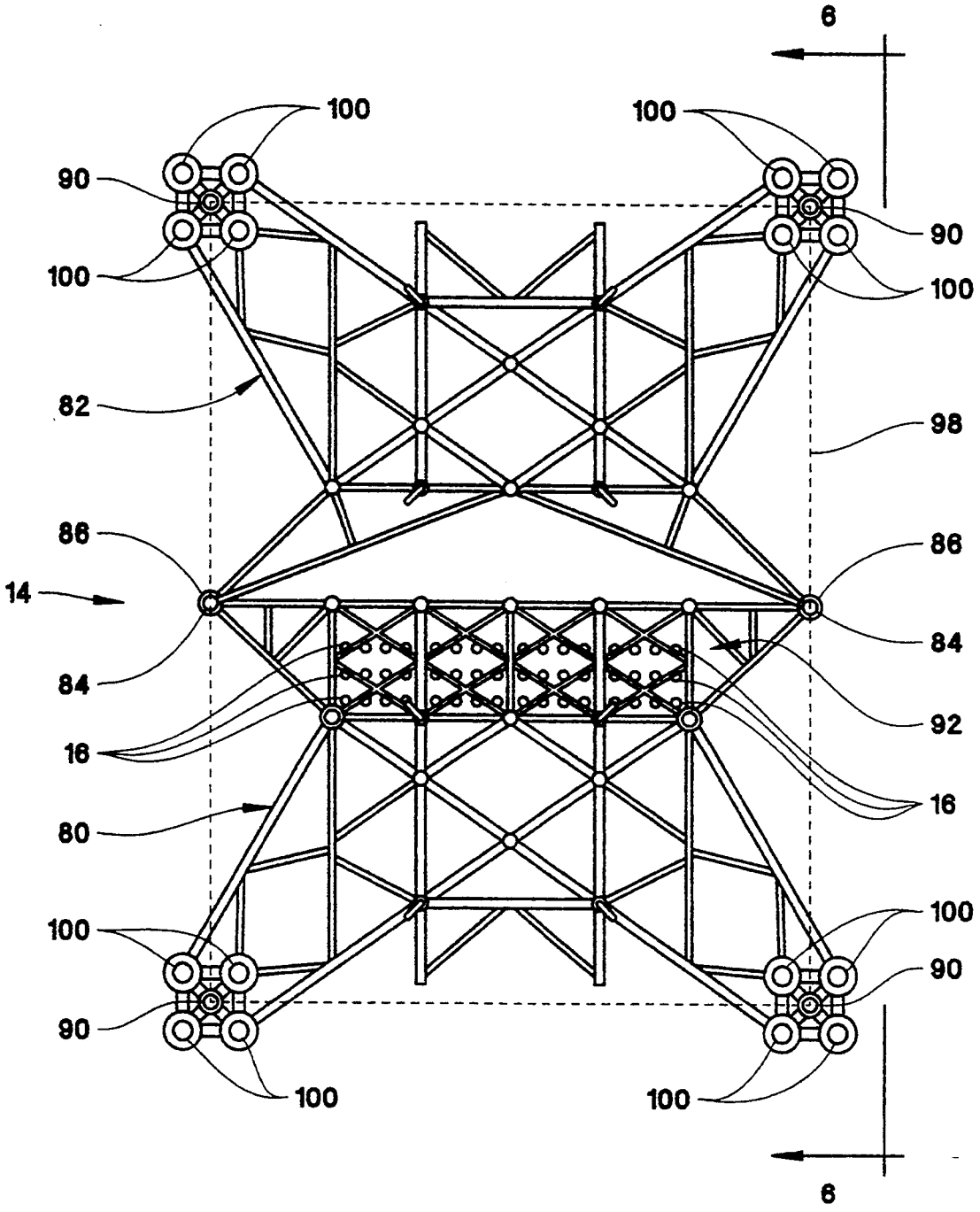
FIG. 5 is a plan view of a first embodiment of the guide template of the present invention.
Figure 6:
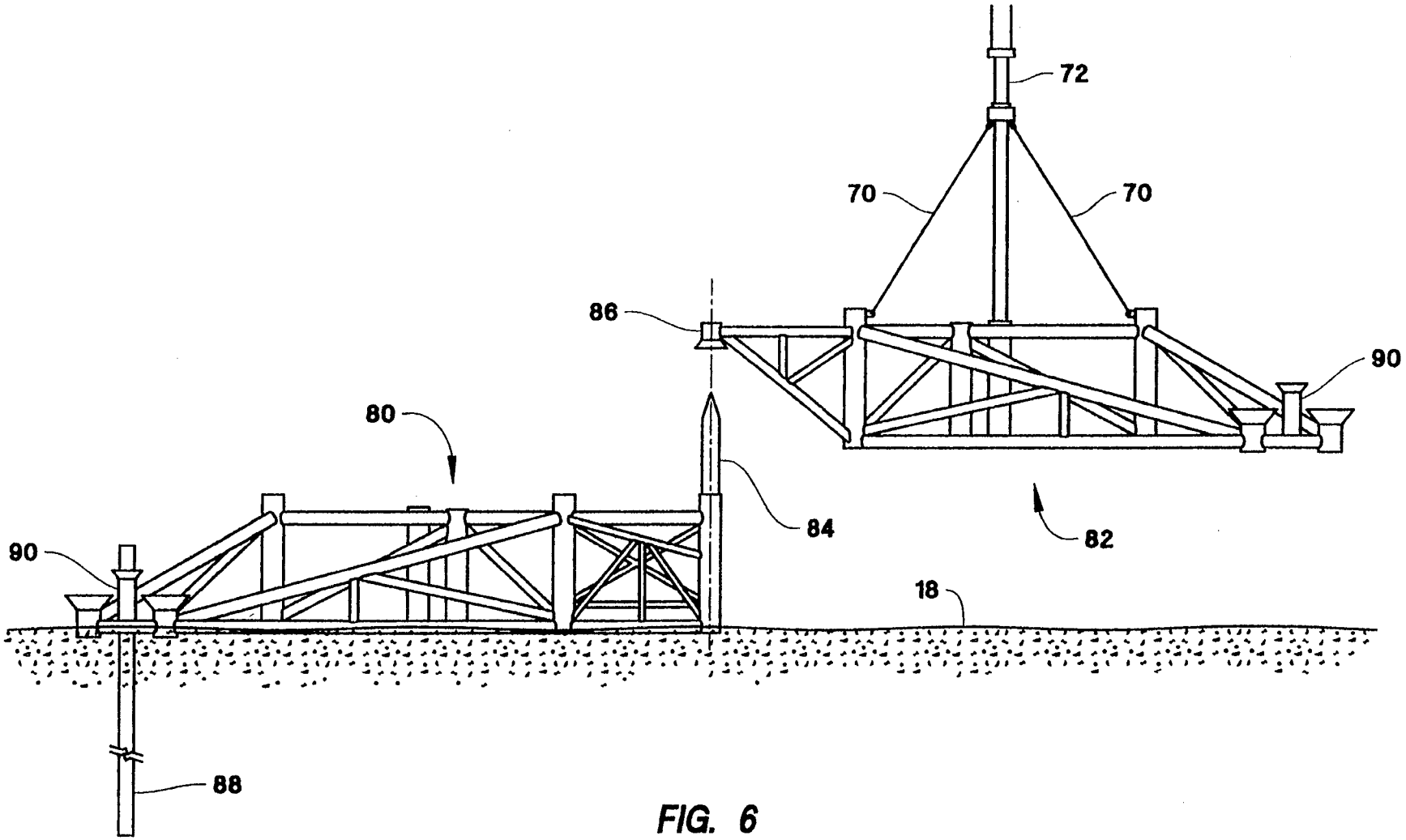
FIG. 6 is an elevation view illustrating installation of the guide template of FIG. 5.

One possible guide template design for a typical CPT is illustrated in FIGS. 5 and 6. The guide template 14 comprises two separate sections 80, 82 which are remotely connected on seafloor 18 by means of guide posts 84 attached to template section 80 and guide cones 86 attached to template section 82. As illustrated in FIG. 6, template section 80 is positioned on seafloor 18 and fixed in place by means of pin piles 88 which extend through pin pile guide sleeves 90. Pin piles 88 may be installed by drilling and grouting, pile driving, jetting, or any other installation technique known to those skilled in the art. Typically, pin piles 88 extend downwardly a distance of 100 feet or more depending on the subterranean soil conditions. Other suitable methods for installing template section 80 will be apparent to those skilled in the art.

After template section 80 has been positioned on seafloor 18 and attached thereto, template section 82 is lowered in the manner previously described until guide cones 86 engage guide posts 84. A remotely-operated vehicle may be used to aid in positioning template section 82. After template section 82 has been positioned on the seafloor 18, it is fixed to the seafloor by pin piles (not shown) extending through pin pile guide sleeves 90, as previously described in connection with template section 80.

It may be necessary to level either or both of the template sections 80, 82 after they are positioned on seafloor 18. One method for accomplishing this leveling operation would be to attach leveling jacks between the template section and its pin piles. The attitude of the template may then be adjusted using the leveling jacks. Other suitable methods for leveling the template sections will be known to those skilled in the art.

As illustrated in FIG. 5, template section 80 includes a well guide portion, generally indicated at 92. Well guide portion 92 includes a plurality (48 as illustrated) of generally cylindrical well slots 16 for use as previously described. Template sections 80 and 82 may optionally include additional equipment such as pick-up hooks for lifting the template sections off the seafloor 18 or hydraulic piping and fittings for operating template leveling equipment.

Figure 7:
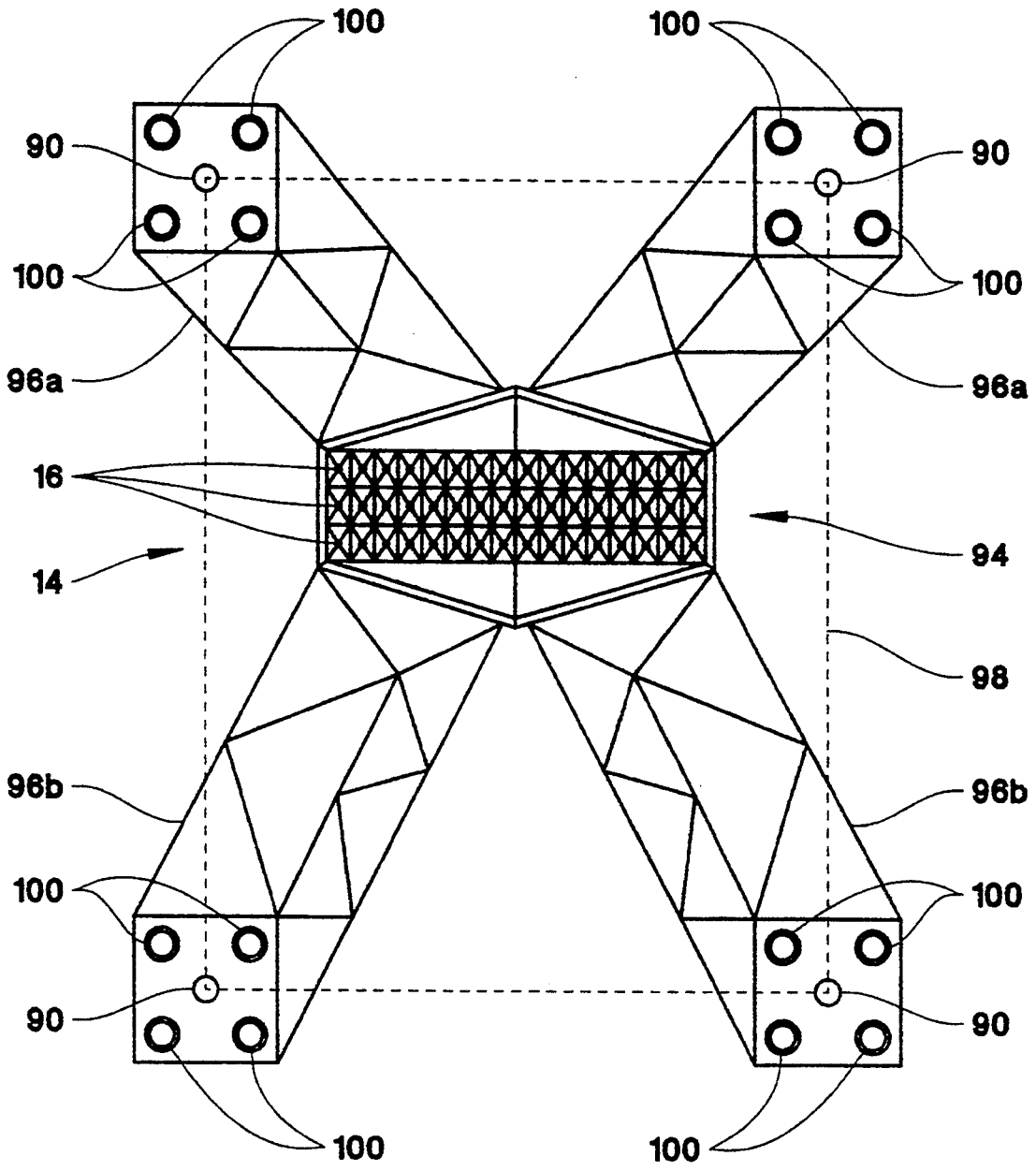
FIG. 7 is a plan view of a second embodiment of the guide template of the present invention.

FIG. 7 illustrates an alternate guide template design which consists of a well template 94 and four pile templates **96*a*, 96*b*. As illustrated, two of the pile templates 96*a* are shorter than the other two pile templates 96*b*. In this manner, the fully assembled guide template 14 will be dimensionally identical to the previous embodiment illustrated in FIGS. 5 and 6. Installation of the guide template illustrated in FIG. 7 would proceed in the same manner as described above with respect to the previous embodiment. First, well template 94 is positioned on seafloor 18 and attached thereto, typically by one or more pin piles (not shown) as described above. Then the four pile templates 96*a*, 96*b* are individually lowered, indexed off of well template 94**, and fixed in place. The indexing operation may be accomplished by the use of guide posts and guide cones in the manner described above. Alternatively, other means for accomplishing the indexing operation will be apparent to those skilled in the art.

In FIGS. 5 and 7, a rectangle 98 is indicated by dashed lines. Rectangle 98 represents the outer perimeter of tower structure 62 (see FIG. 3) near the seafloor 18. Both embodiments of guide template 14 also include a total of sixteen foundation pile guide sleeves 100, four at each comer of rectangle 98. Of the four pile guide sleeves 100 located at each corner of rectangle 98, one is located inside the perimeter of tower structure 62 and the other three are located outside the perimeter. Preferably, foundation piles **64*a* (see FIG. 3) are pre-installed through at least the four foundation pile guide sleeves 100 located inside the perimeter 98 of tower structure 62. As more fully described below, pre-installation of at least these four foundation piles 64*a* permits the tower structure 62 to be made storm-safe in a relatively short period. If desired, foundation piles 64*a* may be pre-installed in all sixteen of the foundation pile guide sleeves 100. Foundation piles 64*a* may be up to 84 inches or more in diameter and may extend downwardly into the earth a distance of 500 feet or more depending on the subterranean soil conditions. Typically, foundation piles 64*a* extend slightly (a few feet) above guide template 14 to facilitate connection to spring piles 64*b*, as more fully described below. Foundation piles 64*a* are not grouted or otherwise attached to foundation pile guide sleeves 100. In this manner, guide template 14** is isolated from the vertical loads resulting from the weight of the structure.

Figure 8:
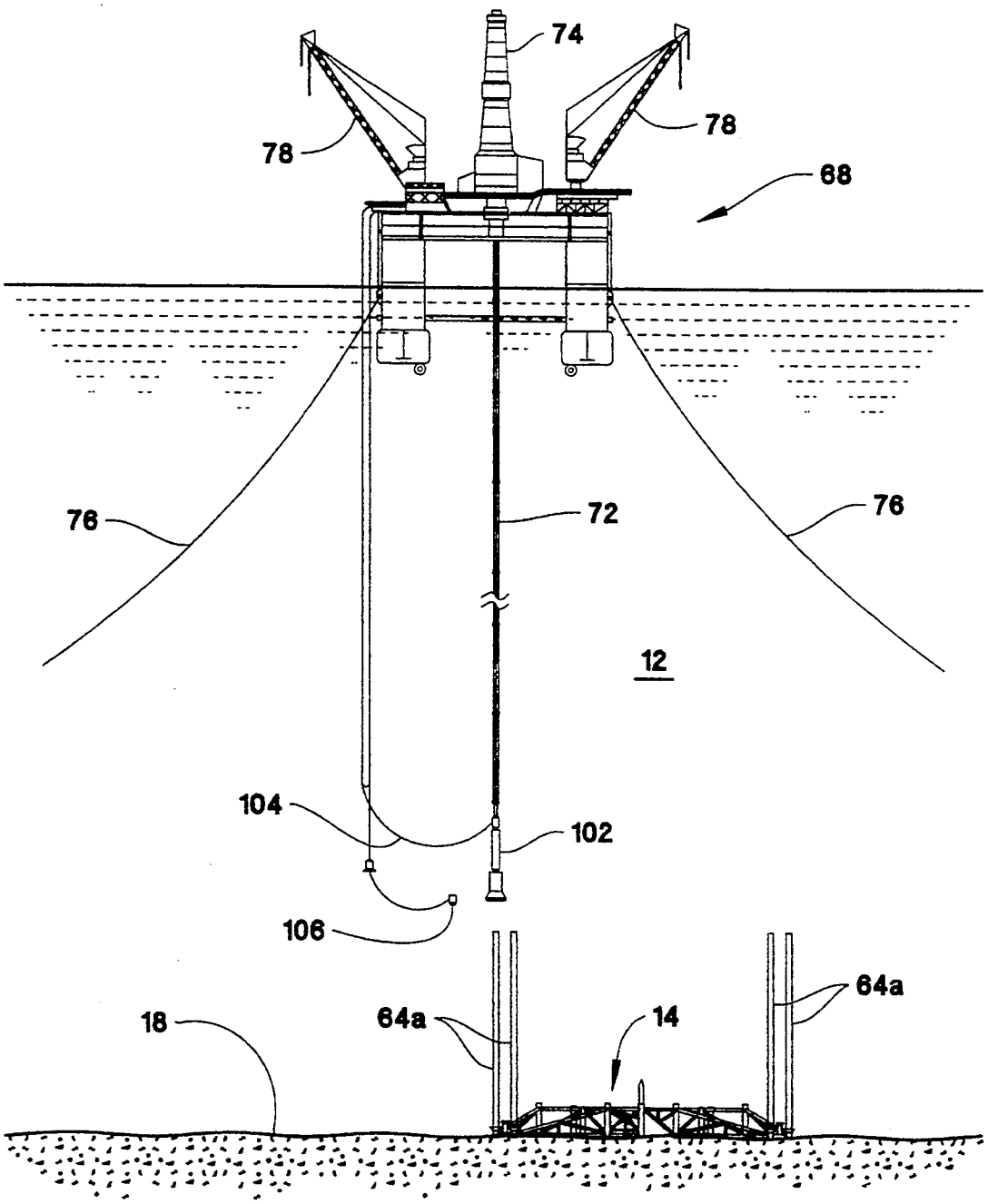
FIG. 8 illustrates installation of the foundation piles for the offshore platform, prior to installation of the platform itself, using an underwater hammer suspended beneath a floating drilling vessel.

As illustrated in FIG. 8, foundation piles **64*a* may be installed by pile driving using an underwater hammer 102 attached to the lower end of drill string 72. Alternatively, underwater hammer 102 could be lowered on a cable, as is well known in the art. A hydraulic line 104 extending upwardly to floating drilling vessel 68 would be used to power the underwater hammer 102. A remotely-operated vehicle 106 or an underwater television camera (not shown) may be used to aid in positioning the underwater hammer 102 above the particular foundation pile 64***a* being driven. Alternatively, foundation piles 64*a* may be installed by drilling and grouting as is well known in the art. Also, a floating construction vessel could be substituted for floating drilling vessel 68 without departing from the scope of the present invention.

After installation of the guide template 14 has been completed, as described above, the tower structure 62 (see FIG. 3) is installed. The guide template may optionally include one or more indexing probes or other devices designed to ensure that the tower structure 62 is properly aligned with the guide template 14. For example, pin piles 90 (see FIGS. 5 and 6) may extend a distance above guide template 64 and be designed to mate with corresponding recesses in the tower structure 62 to ensure proper alignment. Preferably, at least four of the spring piles 64*b* (one at each corner of the tower structure 62) are pre-installed in the tower structure 62 and connected to the tower structure 62 at their upper ends. These four piles are preferably the four piles located inside the perimeter 98 of tower structure 62 (see FIGS. 5 and 7). The tower structure 62 is lowered until the lower ends of these four spring piles 64*b* are located immediately above the upper ends of their corresponding foundation piles 64*a*. A connecting means 66 is then used to attach each of the spring piles 64*b* to its corresponding foundation pile 64*a*. Connecting means 66 may be any type of mechanical connector capable of connecting the lower end of each spring pile 64*b* to the upper end of the corresponding foundation pile 64*a*. One type of mechanical connector which is particularly well suited for this purpose is the Hydra-Lok swage-type mechanical connector manufactured by Marine Contractor Services, Inc. of Houston, Tex. A swage-type mechanical connector is one in which hydraulic pressure is used to expand portions of the pile inside corresponding recesses in the connector thereby mechanically locking the pile into the connector.

Use of four pre-installed spring piles 64*b* and swage-type mechanical connectors permits the tower structure 62 to be installed and made storm-safe in a matter of a few hours. This significantly reduces the risk of loss which is inherent in offshore construction operations. Thereafter, the remaining twelve spring piles 64*b* are installed and deck 28 is mounted on the upper end of tower structure 62. Finally, the CPT's wells are completed in the manner hereinbefore described.

It will be understood by those skilled in the art that other types of bottom-founded offshore structures may not utilize spring piles. In this case, the pre-installed foundation piles would be connected to the legs or other structural members of the tower structures in the manner described above.

Use of the well system of the present invention has many advantages over prior offshore platform well systems which will be apparent to those skilled in the art. It should be understood that the invention is not to be unduly limited to the foregoing which has been set forth for illustrative purposes. Various modifications and alternatives will be apparent to those skilled in the art without departing from the true scope of the invention, as defined in the following claims.

We claim:

1. A well system for use in producing hydrocarbons from a subterranean reservoir located beneath a body of water, said well system comprising:

a subsea guide template installed on the seafloor generally above said subterranean reservoir, said subsea guide template having at least one substantially vertical well slot extending therethrough;

an outer casing string installed in said substantially vertical well slot and extending generally downwardly from said subsea guide template to a first predetermined depth less than the depth of said reservoir;

a bottom-founded offshore platform installed generally above said sub sea guide template and extending from said seafloor upwardly to a deck located above the surface of said body of water, said offshore platform being installed after installation of said subsea guide template and said outer casing string;

a wellhead located on said deck of said offshore platform;

a first intermediate casing string installed inside said outer casing string and extending downwardly to a second predetermined depth deeper than said first predetermined depth but less than the depth of said reservoir;

an inner casing string installed inside said first intermediate casing string and extending downwardly from said wellhead to said reservoir, said inner casing string being installed after installation of said bottom-founded offshore platform; and a production tubing string installed inside said inner casing string and extending downwardly from said wellhead to said reservoir, whereby hydrocarbons from said reservoir may be produced to said deck of said offshore platform.

2. The well system of claim 1, wherein said first intermediate casing string is installed after installation of said offshore platform.

3. The well system of claim 2, wherein said first intermediate casing string comprises:

a subterranean portion extending downwardly from said guide template to said second predetermined depth;

a riser portion extending upwardly from said guide template to said wellhead on said deck of said offshore platform; and means for releasably connecting the lower end of said riser portion to the upper end of said subterranean portion.

4. The well system of claim 3, wherein said riser portion is disconnected from said subterranean portion following installation of said inner casing string and removed for possible reuse on another well.

5. The well system of claim 1, wherein said first intermediate easing string comprises:

a subterranean portion extending downwardly from said guide template to said second predetermined depth, said subterranean portion being installed before installation of said offshore platform;

a riser portion extending upwardly from said guide template to said wellhead on said deck of said offshore platform, said riser portion being installed after installation of said offshore platform; and means for releasably connecting the lower end of said riser portion to the upper end of said subterranean portion.

6. The well system of claim 5, wherein said riser portion is disconnected from said subterranean portion following installation of said inner casing string and removed for possible reuse on another well.

7. The well system of claim 1, wherein said well system further comprises:

one or more additional intermediate casing strings located inside said first intermediate casing string and outside said inner casing string, each of said additional intermediate casing strings extending downwardly to a predetermined depth deeper than the depth of the next larger intermediate casing string but less than the depth of said reservoir.

8. The well system of claim 1, wherein said subsea guide template further includes indexing means adapted to aid in properly aligning said offshore platform and said subsea guide template.

9. The well system of claim 1, wherein said subsea guide template further includes at least one foundation pile guide sleeve located and sized so as to guide the installation of a foundation pile for said offshore platform.

10. The well system of claim 9, wherein said foundation pile is installed before installation of said offshore platform and extends from a point at or above said guide template downwardly to a predetermined pile depth, and wherein said offshore platform includes connection means adapted to mate with and connect to the upper end of said foundation pile during installation of said offshore platform.

11. The well system of claim 1, wherein said inner casing string comprises:

a first portion extending downwardly from said wellhead to a third predetermined depth deeper than said second predetermined depth but less than the depth of said reservoir; and a second portion installed inside said first portion and extending from a point at or above said third predetermined depth downwardly to said reservoir.

12. A method for installing a well system for use in producing hydrocarbons from a subterranean reservoir located beneath a body of water, said method comprising the steps of:

installing a subsea guide template on the seafloor generally above stud subterranean reservoir, said subsea guide template having at least one substantially vertical well slot extending therethrough;

installing an outer casing string in said substantially vertical well slot, said outer casing string extending generally downwardly from said subsea guide template to a first predetermined depth less than the depth of said reservoir;

installing a bottom-founded offshore platform generally above said subsea guide template, said bottom-founded offshore platform extending from said sea floor upwardly to a deck located above the surface of said body of water, said bottom-founded offshore platform being installed after installation of said subsea guide template and said outer casing string;

installing a wellhead on said deck of said offshore platform;

installing a first intermediate casing string inside said outer casing string, said first intermediate casing string extending downwardly to a second predetermined depth deeper than said first predetermined depth but less than the depth of said reservoir;

installing an inner casing string inside said first intermediate casing string, said inner casing string extending downwardly from said wellhead to said reservoir, said inner casing string being installed after installation of said bottom-founded offshore platform; and installing a production tubing string inside said inner casing string, said production tubing string extending downwardly from said wellhead to said reservoir for producing hydrocarbons to said deck of said offshore platform.

13. The method of claim 12, wherein said first intermediate casing string is installed after installation of said offshore platform.

14. The method of claim 13, wherein said first intermediate casing string has a subterranean portion extending downwardly from said guide template to said second predetermined depth, a riser portion extending upwardly from said guide template to said wellhead, and means for releasably connecting the lower end of said riser portion to the upper end of said subterranean portion, and wherein said method further comprises the steps of disconnecting and removing said riser portion from said subterranean portion following installation of said inner casing string.

15. The method of claim 12, wherein said step of installing said first intermediate casing string further comprises:

installing a subterranean portion extending downwardly from said guide template to said second predetermined depth, said subterranean portion being installed before installation of said offshore platform;

installing a riser portion extending upwardly from said guide template to said wellhead, said riser portion being installed after installation of said offshore platform; and releasably connecting the lower end of said riser portion to the upper end of said subterranean portion.

16. The method of claim 15, wherein said method further comprises the steps of disconnecting and removing said riser portion from said subterranean portion following installation of said inner casing string.

17. The method of claim 12, wherein said method further comprises: installing one or more additional intermediate casing strings inside said first intermediate casing string and outside said inner casing string, each of said additional intermediate casing strings extending downwardly to a predetermined depth deeper than the depth of the next larger intermediate casing string, but less than the depth of said reservoir.

18. The method of claim 12, wherein said method further comprises providing indexing means on said subsea guide template, said indexing means adapted to aid in properly aligning said offshore platform and said subsea guide template.

19. The method of claim 12, where in said method further comprises providing at least one foundation pile guide sleeve on said subsea guide template, said foundation pile guide sleeve being located and sized so as to guide the installation of a foundation pile for said offshore platform.

20. The method of claim 19, wherein said method further comprises:

installing a foundation pile in said foundation pile guide sleeve before installation of said offshore platform, said foundation pile extending from a point at or above said subsea guide template downwardly to a predetermined pile depth;

providing said offshore platform with connection means adapted to mate with the upper end of said foundation pile during installation of said offshore platform; and connecting said connection means to said upper end of said foundation pile.

21. The method of claim 12, wherein said step of installing said inner casing string comprises:

installing a first portion extending downwardly from said wellhead to a third predetermined depth deeper than said second predetermined depth but less than the depth of said reservoir; and installing a second portion inside said first portion, said second portion extending from a point at or above said third predetermined depth downwardly to said reservoir.

* * * * *

UNITED STATES PATENT AND TRADEMARK OFFICE

CERTIFICATE OF CORRECTION

PATENT NO. : 5,379,844

DATED : January 10, 1995

INVENTOR(S) : M. Sidney Glasscock and Gerasime M. Monopolis

It is certified that error appears in the above-identified patent and that said Letters Patent is hereby corrected as shown below:

| Column | Line | |
|---|---|---|
| 8 | 3 | "easing" should be "casing". |
| 8 | 26 | "1 inches" should be "12 inches". |
| 9 | 5 | "FIG. 74" should be "rig 74". |
| 12 | 57 | "easing" should be "casing". |
| 13 | 45 | "stud" should be "said". |

Signed and Sealed this

Fourth Day of July, 1995

Bruce Lehman

*Attest:*

BRUCE LEHMAN

*Attesting Officer*

*Commissioner of Patents and Trademarks*